United States Patent [19]

Werner

[11] Patent Number: 4,951,407

[45] Date of Patent: Aug. 28, 1990

[54] YIELDABLE SIGN STAND

[75] Inventor: William A. Werner, Salem, Oreg.

[73] Assignee: Flex-O-Lite, Inc., St. Louis, Mo.

[21] Appl. No.: 117,032

[22] Filed: Nov. 4, 1987

[51] Int. Cl.[5] ..... G09F 15/00

[52] U.S. Cl. ..... 40/608; 40/602; 248/160

[58] Field of Search ..... 40/606, 607, 608, 612, 40/602; 404/10; 248/622, 623, 160, 900

[56] References Cited

U.S. PATENT DOCUMENTS

| | | | |
|---|---|---|---|
| 626,256 | 6/1899 | Webb | 40/613 |
| 1,013,410 | 1/1912 | Lynch | 403/229 |
| 1,089,143 | 3/1914 | Mayer | 40/613 |
| 1,135,372 | 4/1915 | Gibson | 267/71 |
| 1,367,830 | 2/1921 | Poole | 40/608 |
| 1,402,465 | 1/1922 | Wood | 40/608 |
| 1,449,063 | 3/1923 | Shotwell | 40/613 |
| 1,487,635 | 3/1924 | Watts | 40/608 |
| 1,532,865 | 4/1925 | Beck | 404/11 |
| 1,541,200 | 6/1925 | Thomson | 40/606 |
| 1,599,066 | 9/1926 | Rushmore | 40/608 |
| 1,662,298 | 3/1928 | Corey | 404/11 |
| 1,679,623 | 8/1928 | Olsen | 40/608 |
| 1,726,817 | 9/1929 | Franklin | 40/608 |
| 1,750,118 | 3/1930 | Mueller, Jr. | 40/613 |
| 1,760,270 | 5/1930 | Griswold | 40/608 |
| 1,828,892 | 10/1931 | Felton | 126/173 |
| 1,856,349 | 5/1932 | Bigelow | 40/613 |
| 1,903,683 | 4/1933 | Nute | 40/608 |
| 2,096,275 | 10/1937 | Doyle | 40/145 |
| 2,099,558 | 11/1937 | Dibelka et al. | 220/86 |
| 2,103,410 | 12/1937 | Frei, Sr. | 404/10 |
| 2,117,148 | 5/1938 | Clark | 16/183 |
| 2,141,067 | 12/1938 | Miller | 40/608 |
| 2,144,038 | 1/1939 | Trump | 250/33 |
| 2,155,992 | 4/1939 | Menachof | 40/125 |
| 2,164,680 | 7/1939 | Donovan | 40/145 |
| 2,165,704 | 7/1939 | Hood | 40/145 |
| 2,168,912 | 9/1939 | Meyer | 248/33 |
| 2,193,747 | 3/1940 | Thompson | 40/145 |
| 2,243,912 | 6/1941 | Legler | 248/160 |
| 2,292,785 | 8/1942 | Henne | 40/125 |
| 2,308,525 | 1/1943 | Lowe | 40/125 |
| 2,532,996 | 12/1950 | Clark et al. | 16/183 |
| 2,602,684 | 7/1952 | Pinke | 287/160 |
| 2,949,321 | 8/1960 | Birge et al. | 287/86 |
| 3,013,381 | 12/1961 | Parsons | 60/23 |
| 3,115,325 | 12/1963 | Batcha | 248/204 |
| 3,616,557 | 11/1971 | Varn, Sr. | 40/138 |
| 3,646,696 | 3/1972 | Sarkisian | 40/125 H |
| 3,662,482 | 5/1972 | Sarkisian | 40/125 H |
| 4,038,769 | 8/1977 | Werner | 40/608 |
| 4,137,667 | 2/1979 | Baumer | 40/612 |
| 4,498,657 | 2/1985 | Werner | 248/623 |
| 4,676,015 | 6/1987 | Stoudt | 40/608 |

FOREIGN PATENT DOCUMENTS

| | | | |
|---|---|---|---|
| 241196 | 7/1960 | Australia | 54.16/54.14 |
| 328621 | 4/1958 | France . | |
| 328624 | 4/1958 | Switzerland . | |

*Primary Examiner*—Gene Mancene
*Assistant Examiner*—Michael Lynch
*Attorney, Agent, or Firm*—Edward H. Renner

[57] ABSTRACT

A sign stand for supporting signs in windy environments includes a base, a staff portion extended from the base and an upper portion for receiving and displaying a sign. The sign stand includes a mechanism permitting pivoting of the sign to spill wind load and includes a mechanism for applying a restoring force to restore the sign to its normal vertical position on removal of the wind load. The restoring mechanism may be incorporated in the base structure and can utilize a tension spring to provide the restoring force.

21 Claims, 1 Drawing Sheet

YIELDABLE SIGN STAND

BACKGROUND AND SUMMARY OF THE INVENTION:

This application relates to stands for supporting display signs, such as those for advertising or for display purposes generally, but particularly with regard to highway safety informational signs. Highway safety signs, of applicants' type, are designed to support an information display and be resiliently yielding to windy conditions which are often encountered along highways and in construction areas.

Applicant is aware of the following U.S. Pat. Nos. the disclosures of which are incorporated by reference herein:

| | | | | | |
|---|---|---|---|---|---|
| 626,256; | 1,013,410; | 1,089,143; | 1,135,372; | 1,367,830; | 1,449,063; |
| 1,487,635; | 1,532,865; | 1,599,066; | 1,662,298; | 1,726,817; | |
| 1,750,118; | 1,760,270; | 1,828,892; | 1,856,349; | 1,903,683; | |
| 2,096,275; | 2,099,558; | 2,117,148; | 2,144,038; | 2,155,992; | |
| 2,164,680; | 2,165,704; | 2,168,912; | 2,193,747; | 2,243,912; | |
| 2,292,785; | 2,308,525; | 2,532,996; | 2,602,684; | 2,949,324; | |
| 3,013,381; | 3,115,325; | 3,616,557; | 3,646,696; | 3,662,482; | |
| 4,137,662; 4,498,657; 4,676,015. | | | | | |

Resilient sign stands of the type known as wind resistant sign stands are well known in the art and find use in outdoor advertising and displays, but have particular use in the highway safety field. These sign stands are portable and are designed to convey information, e.g., to motorist and the like to warn of construction along highways and other temporary hazards. In order to provide as much information and to warn as early as possible, these signs typically are quite large and provide a large surface area in which information can be displayed and conveyed to a motorist.

As a consequence of the large surface area of the signs, the signs are often subjected to a very high wind load. If the signs were rigid the wind load would be sufficient to topple or displace the sign away from its position and render the sign ineffective at warning approaching motorists; it being understood that the signs are not permanently anchored. To prevent displacement by a high wind load, the art has devised what is known as the wind resistant sign.

In general, two approaches have been taken to permit a sign to deflect resiliently upon application of a wind load. Both approaches utilize a yielding structure with a means for applying a restorative force when the sign is deflected away from its normal position, which is usually vertical. Typically the means to restore the sign to a vertical position is a spring. In the first design, the spring is attached to the sign or the sign mast and is subjected to bending about its major axis when the sign is displaced from its normal vertical position. This type of structure is disclosed in U.S. Pat. Nos. 3,662,482, 3,646,696 and 4,498,657. In the second design a spring is compressed when the sign is displaced, increasing the compressive force in the spring to provide a restorative force to return the sign to its vertical position once the wind load has been removed from the sign. This structure is disclosed in U.S. Pat. No. 4,676,015.

In spite of the numerous designs available in the prior art, a number of difficulties have remained and have not been solved by the designs presently available. Many of the prior devices do not hold the sign stand firmly and rigidly when a small force is applied to the sign. Some designs tend to flutter in the wind under gusting when rapid directional changes occur in the wind.

Many devices require the design and use of special springs for each size and configuration of sign or the use of other special or expensive parts. Some designs require too many separate parts and/or may be complex to assemble, thus requiring excessive labor costs. Some designs are also heavy, incurring greater cost in shipping. As the result of the many different design induced costs, the overall cost of many signs is such that the signs have not fully met the needs of the industry for an economical sign stand. It is these problems and others inherent in previous designs that applicants' improved design solves.

The present invention provides a sign stand for supporting signs in windy environments. The sign stand has a base with legs to support the sign and an upstanding mast which is adapted to receive and support a display sign. Applicant's resilient mechanism can readily be incorporated in the base portion of the sign itself, thus eliminating a significant number of parts and weight from the design. As an alternative, applicant's resilient mechanism can be incorporated as part of a mast received in the base. In this configuration the resilient portion can be placed more closely to the sign itself, if that is desired. In either configuration applicant's device provides vertical rigidity, that is, applicant's mechanism firmly holds a sign in a vertical position so that it may be read by an approaching motorist, for example, but also provides means which are resiliently yieldable under the influence of wind load on the sign to allow the sign to pivot and spill the wind load without toppling the sign base from its original position. Upon the removal of the wind load the sign is resiliently returned to its normal vertical position.

Applicant's device may incorporate guides which restrict flutter or the twisting movement of the sign, for example, in response to gusting wind loads and changes of wind direction. Applicant's construction incorporates a minimum of parts and can be constructed to utilize a variety of resilient spring means including elastomeric spring means either in the biscuit or solid form or in the strap or cord form, such as the well known "bungee" cord. In addition, the standard metallic coil spring may be used. None of these springs are highly specialized. Applicant's device utilizes the tension produced by elongation of the spring means to restore the sign and mechanism to a vertical position on release or removal of a wind load. Applicants' device can be readily constructed out of stock shapes and materials with a minimum of machining and construction and a minimum of specialized parts.

It is thus an object of applicant's invention to provide a resilient sign mechanism which can be produced and shipped at minimal cost.

It is thus an object of applicant's invention to provide a reliable sign mechanism which can be constructed from stock elements to provide a durable resilient sign mechanism.

It is an object of applicant's invention to provide a wind resistant mechanism which is resistant to flutter.

It is thus an object of applicant's invention to provide a wind resistant sign mechanism which operates by utilizing tension in a spring to provide a restoring force to the mechanism and return a displaced sign to a vertical position.

It is an object of applicant's invention to provide a wind resistant sign which can utilize springs of a variety of types, to provide a sign restoring force.

These and other objects of the invention will be more readily apparent by referring to the following description of the drawings and description of the preferred embodiments.

Figure 1:
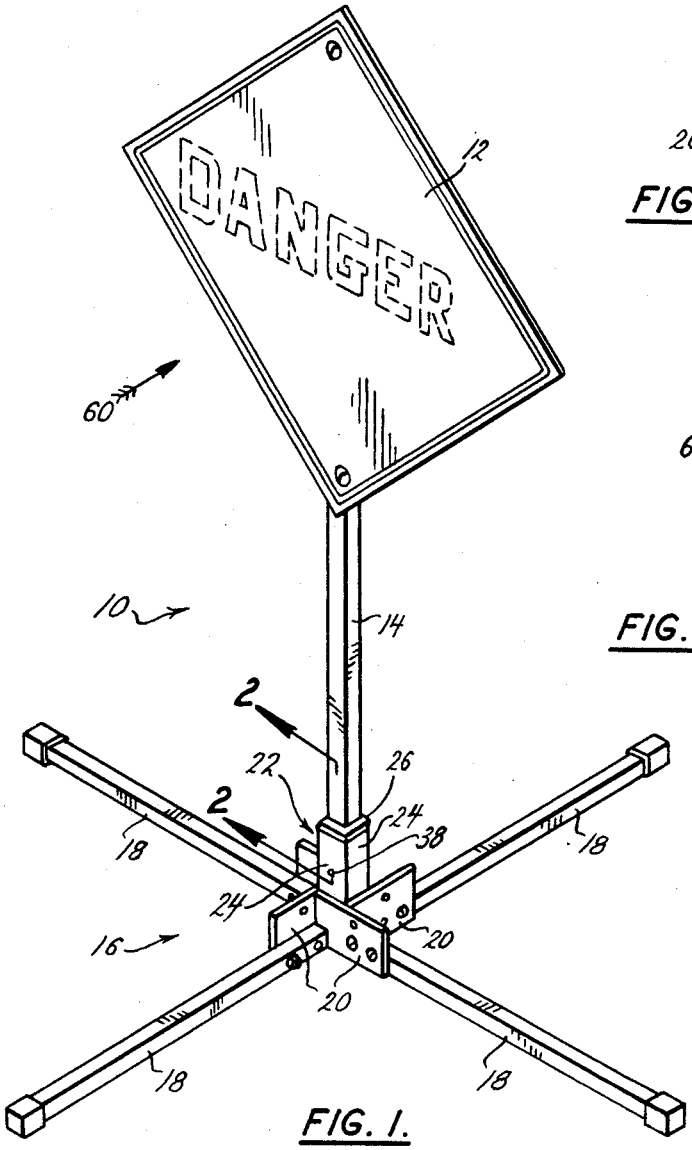
FIG. 1 is a perspective view of a sign stand incorporating applicant's improved mechanism in the sign stand base.

DESCRIPTION OF THE PREFERRED EMBODIMENTS:

Referring to FIG. 1 a sign stand 10 is shown supporting a sign 12 on a mast 14. Sign 12 may be any of the types known in the art, either a fabric sign of the type known as a "roll-up" sign or a solid sign, such as sheet aluminum. Both types are used to carry information and are of the type used in highway construction. Sign stand 10 has a base 16, of the type known in the art, having four legs 18 which may be of the collapsable, telescoping type. Legs 18 may be attached to flanges 20, as is known in the art. Incorporated in base 16 is applicant's resilient restoring mechanism 22, which is shown in more detail in FIG. 2.

Figure 2:
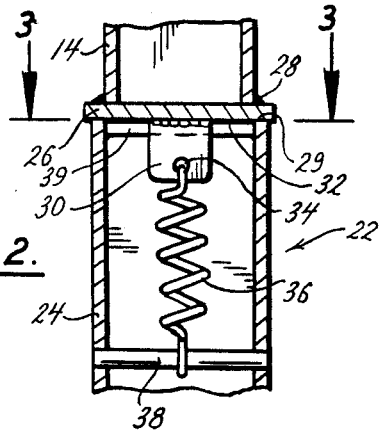
FIG. 2 is a partial cross-sectional view of the sign stand base shown in FIG. 1 showing applicant's improved mechanism.
Figure 3:
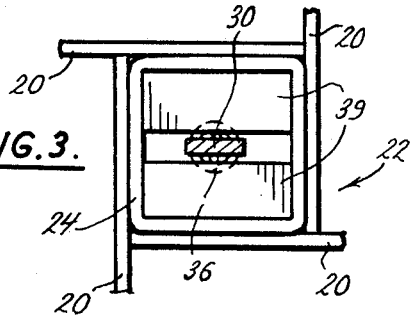
FIG. 3 is a partial cross-sectional view of FIG. 2 taken along the pane of line 3—3.
Figure 4:
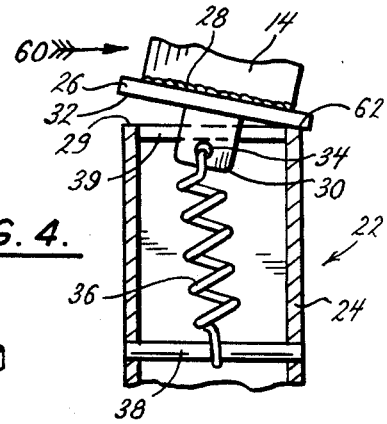
FIG. 4 is a view similar to FIG. 2 showing applicant's mechanism in a displaced condition.

As shown in FIG. 2, applicant's resilient mechanism 22 includes a square tube 24 to which flanges 20 and legs 18 are attached, as by welding or other conventional means. The sign mast 14 is supported by tube 24, as shown. Sign mast 14 is joined to a platform 26, for example by welds 28, and platform 26 rests on the upper edge 29 of tube 24. Platform 26 has a vertically extending plate 30 which extends from the underneath side 32 of platform 26 downwardly into the interior of tube 24, as shown. Plate 30 is joined to platform 26 by welding or other conventional means. Plate 30 is provided with a fastening means, such as a hole 34. Hole 34 permits a spring or other resilient means 36 to be attached to plate 30, as shown. It will be appreciated that spring 36 could be pinned or bolted to plate 30, or that other fastening means could be used. For example a spring 36 could be bolted between a set of parallel plates, not shown. Spring 36 extends downwardly into the interior of tube 24 and is anchored therein, for example by pin 38, as shown. Spring 36 could also be anchored by other fastening means, such as bolts or screws, not shown. As shown in FIGS. 2 through 4, mechanism 22 may also incorporate a pair of spaced plates 39 which act as anti-flutter stops or guides for plate 30, as described herein. A sign mast 14 may also be attached to mechanism 22 by a socket 41, as shown in FIG. 6.

Figure 6:
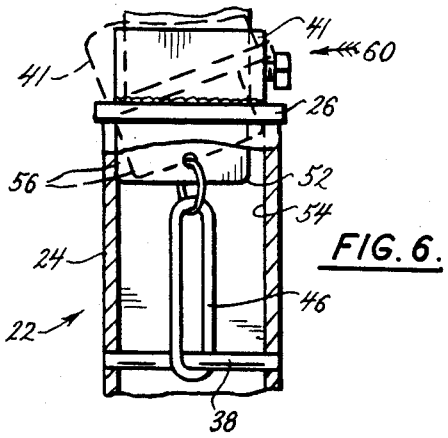
FIG. 6 is a partial cross-sectional view similar to FIGS. 2 and 5 utilizing an elastomeric spring.
Figure 5:
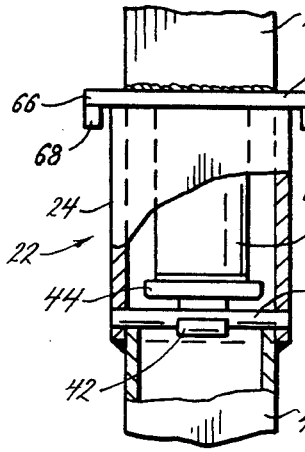
FIG. 5 is a partial cross-sectional view similar to that shown in FIG. 2 utilizing an elastomeric spring.

As shown in FIGS. 2 through 6 applicant's device may utilize a variety of resilient or spring means to provide the restorative effect to a sign stand. As shown in FIG. 2, resilient spring 36 may be a coiled metallic spring in tension, as shown. As shown in FIG. 5, a resilient biscuit 40, such as a polyurethene elastomer, may be attached to pin 38 by a hook 42 which may be joined to biscuit 40 through a metal plate 44. Plate 44 may be adhesively bonded to biscuit 40, as is known in the art, and welded to hook 42. As shown in FIG. 6, a resilient elastomeric cord 46 may be used as a spring means, as shown. Cord 46 may be formed of rubber strands, as is the conventionally known "bungee" elastomeric cord.

Also as shown in FIG. 5, applicant's device may be incorporated in a mast as an alternative to the structure shown in FIGS. 1 and 2, where the mechanism is incorporated in the sign stand base. As shown in FIG. 5, applicant's resilient mechanism 22 is provided with a depending mast 48 which may be installed in a socket in a sign stand base, similar to socket 41 of FIG. 6 or as is known in the art. In the embodiment shown in FIG. 5 the sign restoring mechanism may be placed at a position closer to a sign 12 so that the restorative effect of springs 36, 40 or 46 do not work against as great a mass and moment arm as when the mechanism is incorporated in a base 16.

As shown in the embodiment of FIG. 6, platform 26 may utilize a depending plate 50 which extends into tube 24. Plate 50 is proportioned so that portion 52 thereof impinges on the interior 54 of tube 24 when platform 26 has been pivoted to a predetermined angle. Plate 50 thus acts as a stop to limit the pivoting movement of platform 26, and the travel of associated sign 12, in response to a wind load. Plate 50 also may have a shoulder or camming portion 56 which is spaced adjacent to the interior 54 of tube 24. Shoulder 56 acts to limit rearward displacement of platform 26 and to maintain the position of plate 50 in relation to tube 24. An alternative stop is shown in FIG. 5. In FIG. 5 plate 26 has shoulders 66 which extend beyond tube 24. Shoulders 66 have depending legs 68, as shown. Legs 68 act as stops to limit the travel of platform 26 by impinging on the exterior of tube 24 in a manner analogous to plate 50.

It is anticipated that for most applications the construction shown in FIG. 2 will be the more common, since it is highly effective and is the most economical of construction. In either form it will be appreciated that the device shown is constructed primarily of stock elements, tubes, springs, plates and rods, and does not require special elements or expensive parts. Applicant's device thus provides the greatest economy of construction. It should also be appreciated that due to the compact design employed, applicant's device can be produced with a lower unit weight, thus providing economies in shipping and in purchase of raw material. While the sign stand in FIG. 2 is shown with a sign mast 14 connected to platform 26, it will be appreciated that a socket 41, for receiving a sign mast 14, may also be used, as shown in FIG. 6.

OPERATION OF THE DEVICE:

Applicant's device operates to provide a wind resistant sign by permitting the sign to pivot, as described herein, and spill a wind load acting normal to the sign 12. In achieving that function applicant's device acts as follows: when a wind load, represented by arrow 60 as shown in FIG. 4, is applied in a direction normal to the surface of sign 12, as shown in FIG. 1, the force exerted on sign 12 acts to pivot mast 14 and platform 26 about point 62, as shown in FIG. 4. This pivoting action continues so that mast 14 and sign 12 attached thereto are displaced from their normal vertical position and sign 12 and mast 14 assume a position at an angle with respect to wind load 60. At this position the projected area of sign 12 is reduced to the point that the restorative force exerted by spring 36, 40 or 42 and the wind load are in equilibrium. It will be appreciated that as sign 12, mast 14 and platform 26 pivot under the influence of wind load 60, plate 30 also pivots and elongates spring 36, 40 or 46 to increase the tension in those springs and thus the force tending to restore platform 26, mast 14 and sign 12 to their original positions. When wind load 60 is withdrawn or diminished, the sign stand, including plate 30, platform 26, mast 14 and sign 12 will thus return to their original positions.

With regard to plates 39, the function of those plates is as follows: plates 39 are spaced closely adjacent to plate 30, as shown in FIG. 3, so that any twisting action applied to the sign 12, for example by varying wind gusts, is dampened out by plate 30 impinging against plates 39. Plates 39 thus act as stops to limit the twisting action or flutter of the sign 12. It will be appreciated that in some instances, for example in environments where low gusting wind is experienced, stop plates 39 may not be required in the design. The limit of travel due to the pivoting action of mast 14 and its associated parts may be controlled by choosing the proper relative proportions to the parts, as described herein. By choosing a plate 30, or 50 as shown in FIG. 6, of proper size in relation to the internal diameter of tube 24 a limit can be provided for the pivoting travel of mast 14 by impinging plate 30 or 50 against the inside of tube 24, as previously described. In many environments it may not be necessary to include stops, such as elements 50, 52 and 56, in the design.

Typically tube 24 is a square tube of about three inches internal diameter, though other shapes and sizes could also be used. Plate 30 may be a plate of about ¼ to ⅜ inch in thickness having a length depending into the tube of about one to two inches and having a width of about one inch. Springs 36, 40 and 46 may be a variety of strengths depending upon the mass of the sign and the environmental conditions in which the sign is to be used. Typically the spring will have a spring constant of from about 200 to 300 pounds per inch, preferably about 250 pounds per inch, and will be installed to have a pre-stressed force of from about 50 to 100 pounds. The maximum extension of the spring will typically be from about two to two and one half inches. These values are not critical and other parameters may be used, as desired.

It will be appreciated by those skilled in the art that many modifications may be made to the device as disclosed herein without departing from the spirit of the invention disclosed and claimed. The invention is not to be limited to the embodiments shown herein for purposes of illustration, but only by the scope of the claims appended hereto and their equivalents.

I claim:

1. A wind resistant sign stand for supporting signs subjected to wind loads, the sign stand having a sign mounting means and a base supporting the sign stand on a surface, the sign stand including resilient means to permit a sign subjected to a wind load to move in response to the wind load without displacing the sign stand base, the resilient means including means to return the sign to its original position on removal of the wind load, the resilient means including a tension spring, the sign stand including an enclosure and the tension spring being mounted in the enclosure, the resilient means including a first means connecting a first end of the tension spring to the sign mounting means and a second means anchoring a second end of the tension spring to the enclosure at a location remote from the first connecting means, the sign stand including stop means to limit movement of a sign in response to a wind load, the stop means further including means for at least partially positioning the stop means.

2. The device of claim 1 wherein the sign stand includes anti-flutter means in the enclosure.

3. A wind resistant sign stand for supporting signs subjected to wind loads, the sign stand having a sign mounting means and a base supporting the sign stand on a surface, the base having leg means to contact a surface for supporting the sign stand thereon, the legs being connected to the base by leg mounting means, the base having a central boss and the leg mounting means being connected thereto, the sign stand having resilient wind resisting means including a tubular portion in the central boss, the tubular portion comprising a spring receiving enclosure, the sign mounting means having means cooperating with the spring receiving enclosure including pedestal means abutting the spring receiving enclosure and received thereon, the pedestal means including a pivot plate positioned over the spring receiving enclosure and adjacent thereto, the pivot plate having a sign supporting means extending upwardly from the pivot plate, the pivot plate further having a spring attachment means extending downwardly from the pivot plate into the spring receiving enclosure, the sign stand having a tension spring in the spring receiving enclosure, the tension spring having means connecting a first end thereof to the spring attachment means, the sign stand having spring anchoring means in the spring receiving enclosure and the tension spring having means connecting a second end of the tension spring to the spring anchoring means, the pivot plate further comprising a planar element extending into the spring receiving enclosure, the planar element having spring connecting means thereon and the first end of the tension spring being connected thereto, the spring anchoring means including a transverse pin in the spring receiving enclosure and the second end of the tension spring being connected thereto.

4. The device of claim 3 wherein the tubular portion is a square tube.

5. The device of claim 3 wherein the sign stand has anti-flutter means including transverse means spaced adjacent to the pivot plate planar element to contact the planar element on twisting motion thereof.

6. The device of claim 3 wherein the sign mounting means includes a sign mast receiving socket extending upwardly from the pivot plate.

7. The device of claim 3 wherein the sign mounting means includes a sign mast extending upwardly from the pivot plate.

8. The device of claim 3 wherein the tension spring is a metallic coil spring.

9. The device of claim 3 wherein the tension spring is an elastomeric spring.

10. The device of claim 3 wherein the pivot plate planar element includes stop means to impinge against the tubular portion of the central boss and limit movement of a sign in response to a wind load.

11. The device of claim 10 wherein the planar element includes spacer means to at least partially position the planar element.

12. A wind resistant sign stand for supporting signs subjected to wind load, the sign stand having a sign mounting means and a base supporting the sign stand on a surface, the sign stand including resilient means to permit a sign subjected to a wind load to move in response to the wind load without displacing the sign stand base, the resilient means including means to return the sign to its original position on removal of the wind load, the resilient means including a tension spring, the sign stand including an enclosure and the tension spring being mounted in the enclosure, the resilient means including a first means connecting a first end of the tension spring to the sign mounting means and a second means anchoring a second end of the tension spring to the enclosure at a location remote from the first connecting means, the base including means for mounting a set of legs to the base, the enclosure being mounted centrally in the base, the enclosure forming a central boss in the base and the leg mounting means being joined to the central boss and extending outwardly therefrom.

13. The device of claim 12 wherein the tension spring is a metallic coil spring.

14. The device of claim 12 wherein the tension spring is an elastomeric spring.

15. The device of claim 12 wherein the first connecting means includes a depending element extending from the sign mounting means into the enclosure.

16. The device of claim 15 wherein the tension spring is connected to the depending element.

17. The device of claim 15 wherein the sign mounting means includes a pivot plate at the lower extremity thereof.

18. The device of claim 17 wherein the first connecting means includes a depending element extending from the pivot plate into the enclosure.

19. The device of claim 18 wherein the tension spring is connected to the depending element.

20. The device of claim 12 wherein the enclosure is connected to the sign mounting means at a location spaced from the base.

21. The device of claim 12 wherein the sign mounting means includes a sign mast socket.

* * * * *